US005391396A

United States Patent [19]

Morrand

[11] Patent Number: 5,391,396

[45] Date of Patent: Feb. 21, 1995

[54] METHOD FOR PROTECTING METAL PRODUCTS AGAINST CORROSION AND METAL PRODUCTS OBTAINED FROM SAID METHOD

[75] Inventor: Claude Morrand, Miramas, France

[73] Assignee: Sollac, Puteaux, France

[21] Appl. No.: 82,940

[22] Filed: Jun. 29, 1993

[30] Foreign Application Priority Data

Jun. 30, 1992 [FR] France ..... 92 08037

[51] Int. Cl.[6] ..... B05D 7/14; C09D 5/08

[52] U.S. Cl. ..... 427/156; 427/318; 427/327; 427/329; 427/330; 427/379; 427/380; 427/384; 427/419.1; 427/419.2; 427/419.5; 427/419.6; 427/421; 427/433; 106/14.26; 106/14.27; 106/14.28; 106/14.29; 106/14.31; 106/14.41; 106/14.42; 106/14.43; 428/467; 428/469

[58] Field of Search ..... 106/14.26, 14.27, 14.28, 106/14.29, 14.31, 14.34, 14.41, 14.42, 14.43, 14.44; 252/387, 389.1, 390, 394; 427/156, 318, 327, 329, 330, 379, 380, 384, 419.1, 419.2, 419.5, 419.6, 421, 433

[56] References Cited

U.S. PATENT DOCUMENTS

| | | | |
|---|---|---|---|
| 2,218,557 | 10/1940 | Shoemaker | 427/318 |
| 2,371,853 | 3/1945 | Smith et al. | 106/14.26 |
| 2,430,058 | 11/1947 | Klaber | 106/14.26 |
| 2,784,104 | 3/1957 | Baseman et al. | 106/14.31 |
| 3,597,152 | 8/1971 | Shaw | 427/318 |
| 4,157,991 | 6/1979 | Pilla | 106/14.26 |
| 4,247,414 | 1/1981 | Kimura et al. | 106/14.26 |
| 4,264,363 | 4/1981 | Cech | 106/14.29 |
| 4,495,225 | 1/1985 | Ciuba et al. | 106/14.29 |
| 4,687,634 | 8/1987 | Baseman et al. | 106/14.29 |
| 5,230,730 | 7/1993 | Speckmann et al. | 106/14.13 |

FOREIGN PATENT DOCUMENTS

| | | | |
|---|---|---|---|
| 543427 | 7/1957 | Canada | 106/14.27 |
| 2325730 | 4/1977 | France . | |
| 1047347 | 12/1958 | Germany | 106/14.27 |
| 274038 | 12/1989 | Germany | 106/14.26 |
| 54-010347 | 1/1979 | Japan | 106/14.26 |
| 57-023068 | 2/1982 | Japan | 106/14.26 |
| 241AD1911 | 1/1912 | United Kingdom . | |
| 810715 | 3/1959 | United Kingdom | 106/14.27 |
| 2179363 | 3/1987 | United Kingdom | 106/14.29 |
| 255467 | 3/1970 | U.S.S.R. | 106/14.27 |
| 9105033 | 4/1991 | WIPO . | |

*Primary Examiner*—Anthony Green
*Attorney, Agent, or Firm*—Oblon, Spivak, McClelland, Maier & Neustadt

[57] ABSTRACT

The method for providing a temporary protection against corrosion of a cleaned metal product, in particular a metal sheet, comprises the following steps:

applying on at least a part of the metal product an emulsion obtained by dispersion in water of 3 to 13% by volume of an oily phase comprising 75 to 90% by volume of at least one mineral oil, 5 to 10% by volume of at least one surface-active agent, and 5 to 15% by volume of at least one corrosion inhibitor, drying the coated metal product until a dry film is obtained.

19 Claims, 1 Drawing Sheet

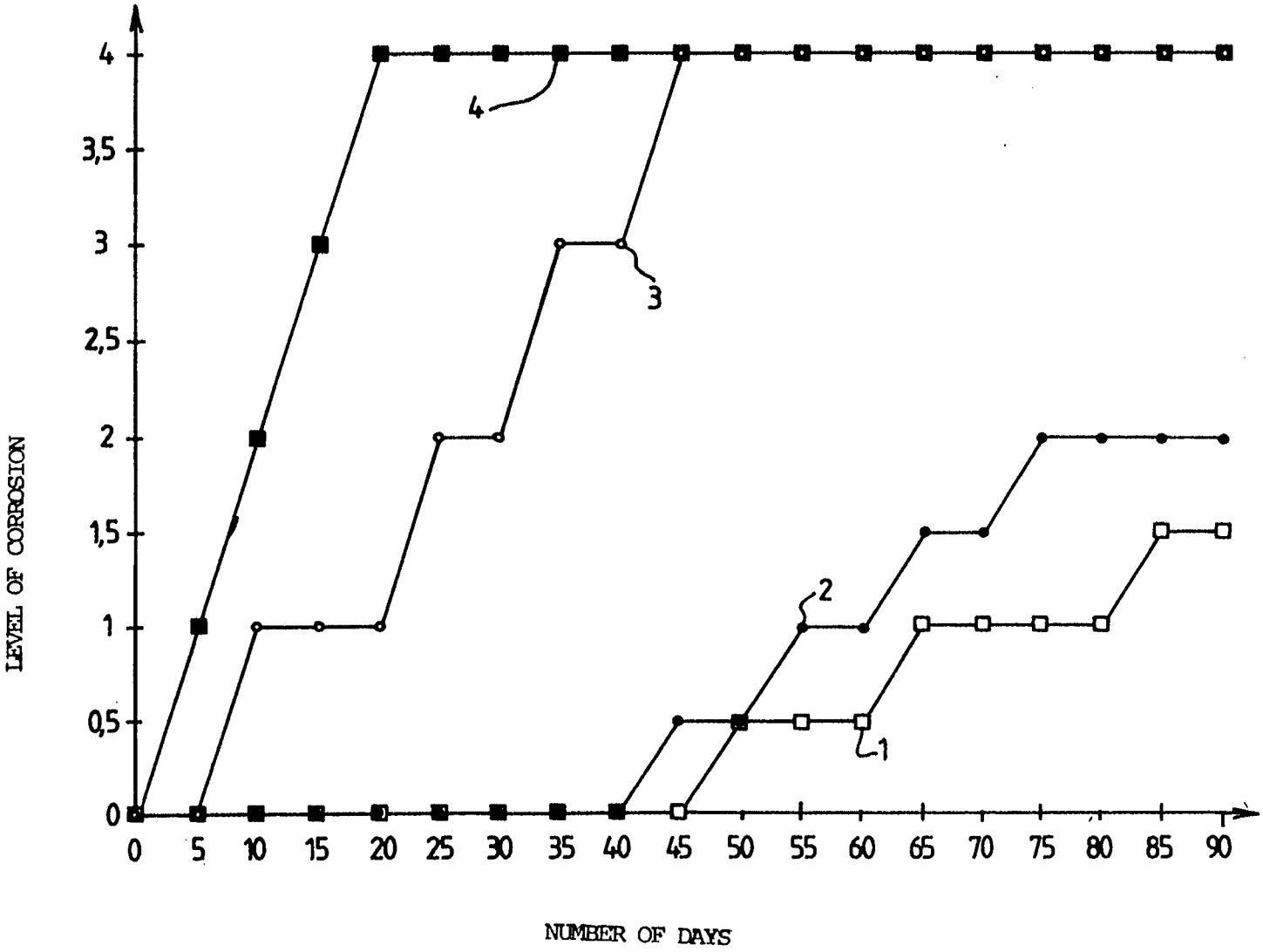
LEVEL OF CORROSION
4
3,5
3
2,5
2
1,5
1
0,5
0
0
5
10
15
20
25
30
35
40
45
50
55
60
65
70
75
80
85
90
NUMBER OF DAYS
1
2
3
4

METHOD FOR PROTECTING METAL PRODUCTS AGAINST CORROSION AND METAL PRODUCTS OBTAINED FROM SAID METHOD

The present invention relates to a method for providing a temporary protection against corrosion of a metal product, in particular a metal sheet.

The problem of the protection of metal surfaces and more particularly metal sheets against atmospheric corrosion is a constant preoccupation of manufacturers.

Indeed, after the operations of the hot rolling of flat products and the cold rolling of the latter for reducing the thickness, the sheets obtained are subjected to a cleaning and then stored in a warehouse. The sheets are then often directly exposed to attacks of the ambient medium and corrode in the course of time before reaching the user.

Any alteration or deterioration of the state of the surface of the metal sheets considerably affects the subsequent treatments, for example phosphating, press forming or welding, In order to avoid these drawbacks, it is advisable to isolate the sheets from the ambient medium by covering them with an impervious material resisting the attacks of this medium.

After the pickling and rinsing of the metal products, in particular flat products such as sheets, the latter are treated differently depending on whether they are shipped without a subsequent treatment or subjected to different finishing operations before shipment to the users.

In the first case, it is advisable to provide a protection for a minimum period of three months. A known method for protecting metal sheets against corrosion for at least three months consists in applying to the previously cleaned and dried sheets a film formed by an oil by dipping the sheets in a bath of oil and thereby providing them with a oily coating having a surface density on the order of 1 to 3 g/m$^2$.

In the second case, the previously pickled products are first of all protected for a period on the order of a few days by corrosion inhibitors, such as amine-base corrosion inhibitors, for example the product sold under the trademark RC 305 by the firm CRODA. Subsequent to the finishing operations, the products are protected more durably by the application of an oily protective film such as described previously or are shipped to the user with no particular protection.

The method consisting in applying an oily film on cleaned products which had possibly been subjected to finishing operations, has several serious drawbacks.

Indeed, the user must, before any use of the products, for example subjecting them to a painting, enamelling or galvanization, effect a long removal of the oil from the surfaces of said products in order to avoid an unnecessary pollution of the tools (shears, splitting machine) and the equipment, and also ensure the adherence of the coatings.

Further, these oily films pollute the cleaning baths which must therefore be frequently renewed.

Consequently, in order to avoid the problems caused by the presence of the oily protective film on the cleaned metal products and in particular on the sheets, it is possible either to avoid protecting the products or to employ conventional protective products which provide a resistance to corrosion for a short period, on the order of a few days.

Beyond this period, the corrosion phenomenon very rapidly deteriorates the cleaned products.

An object of the present invention is consequently to overcome the drawbacks of the prior art by providing a method which permits effectively protecting against corrosion metal products, in particular metal sheets, and avoiding the necessity to clean these products before their use.

The present invention therefore provides a method for providing a temporary protection against corrosion of a cleaned metal product, in particular a metal sheet, characterized in that it comprises the following steps:

applying on at least a part of said metal product a coating of an emulsion obtained by the dispersion in water of 3 to 13% by volume of an oily phase comprising 75 to 90% by volume of at least one mineral oil, 5 to 10% by volume of at least one surface-active agent, and 5 to 15% by volume of at least one corrosion inhibitor, drying said coated metal product until a dry film is obtained.

The oil contained in the oily phase of the emulsion may be constituted by a vegetable or animal oil.

Advantageously, the mineral oil of the oily phase is an oil of the paraffin type.

A surface-active agent of the polyoxyethylene type is preferred as the surface-active agent for the oily phase.

There is advantageously employed as the corrosion inhibitor of the oily phase, a carboxylic acid, an alkylsulfonate of barium or sodium or an amine and fatty acid salt.

Advantageously, the aqueous emulsion is applied by spraying.

Advantageously, the method comprises the following steps:

drying said metal product by heating it to a temperature of between 30° and 90° C. during a period of between 2 and 20 seconds, applying on at least a part of said metal product an emulsion obtained by dispersion in water of 3 to 13% by volume of an oily phase comprising 75 to 90% by volume of at least one mineral oil, 5 to 10% by volume of at least one surface-active agent and 5 to 15% by volume of at least one corrosion inhibitor, and drying said coated metal product until a dry film is obtained, preferably by heating said metal product to a temperature of between 70° and 100° C. during a period of between 2 and 20 seconds.

The prior drying operation favours the reactivity of the sheet and the mechanisms of the adherence of the product which will be subsequently applied to said sheet.

A preferred example of the oily phase employed in the aqueous emulsion is constituted by the product sold under the trademark PREVOX 6767 by the firm HENKEL.

Another example is the product sold under the trademark 112 STS by the firm QUAKER.

The metal product is preferably a metal sheet, the dry film being formed on at least one side of said sheet.

The invention also provides a metal sheet coated with a dry film for protection against corrosion obtained by the method according to the invention, characterized in that the dry film comprises 300 to 800 mg/m$^2$ of coated product obtained from the applied emulsion, the quantity of the product being determined by a chemical measuring of the surface-active agent according to the standard NFT 73258.

A better understanding of the invention will be had on one hand from the following examples of a method relating to a previously-cleaned steel sheet and carried out on a treating line, for example by taking a hot rolled metal sheet, and on the other hand from the single FIGURE.

BRIEF DESCRIPTION OF THE DRAWINGS

FIG. 1 shows the evolution of corrosion over a period of time for: an untreated sheet, a sheet treated with a conventional corrosion inhibitor, and sheets treated in accordance with the method of the invention.

The steel sheet is first of all cleaned by pickling the sheet in acid baths, for example in hydrochloric acid, so as to eliminate chemical substances, such as iron oxides constituting the scale, which adhere to the surface of the sheet and would hinder the subsequent application of a coating. Thereafter, the sheet is immersed in tanks of rinsing water so as to remove any trace of acid.

The emulsion according to the invention is then sprayed onto the sheet.

In order to determine the effectiveness of the protection afforded by the dry protective film on the surface of the sheet, a chemical measurement of the film is effected in accordance with the standard NFT 73258 relating to the determination of surface-active agents and detergents.

According to the aforementioned standard, a specimen of the product constituting the film is removed in a given area equal to S ($m^2$) of the sheet by washing with chloroform. The specimen is then placed in a 200 ml standard flask to which 10 ml of water are added.

A volumetric measurement of the specimen is effected by means of a mixed indicator, hyamine, the hyamine solution being titrated at 0.004 mol/1 until the pink colour turns to blue. In designating the volume of hyamine poured (ml) by the letter V and the area of the specimen by the letter S, the quantity of the surface-active agent present on the surface of the sheet has for value:

$$\frac{104}{S} \times V \times 0.004 = x\ \mu eq/m^2$$

which corresponds to a surface-active agent content of $yg/m^2$.

EXAMPLE 1

The sheet, pickled with hydrochloric acid and rinsed, is heated to a temperature of 60° C. by means of hot air dryers so as to dry the sheet.

After drying, there is sprayed onto one side of the pickled steel sheet an aqueous emulsion containing 5% by volume of an oily phase constituted by the product sold under the trademark PREVOX 6767 by the firm HENKEL.

The spraying is carried out by means of conventional spraying nozzles of the "VEEJET" type with a spread angle of 65°, which permits covering a square area with a side dimension of 25 cm on a substrate placed at 20 cm from the nozzle.

With the product in this way distributed over the side of the sheet, the coated sheet is heated to a temperature of 90° C. by means of hot air dryers arranged in a suitable manner.

A dry thin film is in this way formed on the surface of the pickled steel sheet which protects it against corrosion during a minimum period of three months.

The coated sheet is then coiled and placed in a storage hall.

The coils may be directly shipped to users without receiving any particular treatment, the users then being allowed a period of three months for effecting a transformation of the sheet with safety as concerns corrosion.

Painting tests were carried out on specimens taken from said coils, by directly painting the sheet covered with its dry anti-corrosion film, on one hand with a primer of polyurethane type and, on the other hand, with a powder paint of polyester type.

Tests of the adherence of the coating of paint (squaring, the "chevron" test) have shown that the aptitude for receiving paint on the part of the uncleaned sheet, i.e. from which its dry film has not been removed, is just as good as the bare sheet.

The same is true as concerns the hot-dip galvanization and enamelling by an electrostatic spraying.

A simple cleaning is sufficient to eliminate any trace of product on the surface of the sheet and the users are also sure to avoid polluting their equipment.

Further, the coils may be uncoiled for the purpose of finishing the sheets and may be split up before shipment to the users.

The measurement of the deposited dry film according to the method described hereinbefore gave the following values:

$S = 0.016\ m^2$ $V = 2\ ml$ which corresponds to a quantity of surface-active agent of 50 $\mu eq/m^2$, namely a content on the order of 0.5 $g/m^2$.

EXAMPLE 2

The sheet is previously pickled as described with respect to Example 1, rinsed and then dried by means of hot air dryers by heating to a temperature equal to 60° C. so as to favour the reactivity of the sheet and the mechanisms of the adherence of the product.

There is then sprayed onto one side of the pickled and dried steel sheet an aqueous emulsion containing 5% by volume of an oily phase constituted by the product sold under the trademark 112 STS by the firm QUAKER.

The spraying is carried out by means of conventional spraying nozzles of the "VEEJET" type with a spread angle of 65°, which permits covering a square area having a side dimension of 25 cm on a substrate placed at 20 cm from the nozzle.

After having sprayed the product over the surface of the sheet, the latter is heated by means of hot air dryers to a temperature of 90° C. so as to dry the surface and thereby favour the evaporation of the water present on the surface of the product.

The specimen is then measured in a volumetric manner by means of a solution of hyamine titrated at 0.004 mol/1 as previously described.

The measurement of the dry film deposited in accordance with the method described hereinbefore gave the following values:

$S = 0.013\ m^2$

V=0.12 ml which corresponds to a quantity of surface-active agent of 45 μeq/m, namely a content on the order of 0.5 g/m$^2$.

The sheet protected in this way against corrosion for a period of at least three months may then be directly shipped to the user or subjected to a finishing treatment, as explained in Example 1.

It has been found quite surprisingly that the film protecting the sheet does not alter the aptitude of the latter for subsequent treatments, such as phosphating and painting.

The results of the test described hereinafter show in a significant manner the properties of the sheets coated by means of the method according to the invention.

TEST

The test was carried out on specimens of steel sheets measuring 50×100 mm which were pickled in a hydrochloric acid solution, the concentrations in free acidity and in ferrous chlorides being respectively equal to 80 g/l and 90 g/l, at a temperature of 85° C.

After pickling, the specimens are then rinsed in two successive tanks of water, and then dried by rotating the specimens.

There is then sprayed onto a first part of the specimens an aqueous emulsion containing 3% by volume of an oily phase constituted by the product sold under the trademark PREVOX 6767 by the firm HENKEL (1).

There is sprayed onto a second part of the specimens an aqueous emulsion containing 3% by volume of an oily phase constituted by the product sold under the trademark 112 STS by the firm QUAKER (2).

There is also sprayed onto a third part of the specimens an aqueous emulsion containing 3% by volume of an oily phase constituted by the product sold under the trademark RC 305 by the firm CRODA CHEMICALS (3). This product, which is known for its anti-corrosion properties, is essentially constituted by amines.

A specimen which has undergone no treatment against corrosion serves as a reference specimen (4).

All the specimens are dried by means of hot air dryers also at the temperature of 90° C.

The specimens are then exposed to atmospheric conditions in a storage hall at a temperature on the order of 30° C. and at a relative humidity on the orderof 70%.

During several days, the different specimens were inspected by taking into account the appearance of the corrosion with respect to time. The appearance of the corrosion is measured on a measurement scale ranging from 1 to 4, the coefficient 1 being assigned to a specimen on which the first corrosion specks appear, coefficient 4 corresponding to the whole of the corroded surface.

The graph shown in the accompanying Figure represents the comparative evolution of the corrosion over a period of time for the four tests.

The results of the tests show the superiority of the products according to the invention over a conventional corrosion inhibitor such as the RC 305, the process of deterioration of the sheets starting very rapidly with the latter.

The sheets coated with the dry anti-corrosion film according to the invention may be subjected, without prior cleaning, to the coating operations of the dipped galvanization type, to painting or enamelling, and moreover benefit from a very good anti-corrosion protection even after a long storage period. Further, the cleaning or degreasing of the sheets remains very easy after prolonged storage.

What is claimed is:

1. A method for providing temporary protection against corrosion of a cleaned metal product comprising the steps of:

a) drying said cleaned metal product;

b) coating at least one part of the metal product with an emulsion obtained by dispersion in water of 3 to 13% by volume of an oily phase, said oily phase comprising 75 to 90% by volume of at least one mineral oil, 5 to 10% by volume of at least one surface-active agent and 5 to 15% by volume of at least one corrosion inhibitor; and c) drying the resulting coated metal product by heating it to a temperature between 70° to 100° C. until a dry film is obtained, said dry film being present in an amount of from 300 to 800 mg/m$^2$ of coated product.

2. A method according to claim 1, wherein the drying of the cleaned metal product in step a) is performed by heating said product to a temperature of between 30° and 90° C.

3. A method according to claim 1, wherein said at least one mineral oil is a paraffin oil.

4. A method according to claim 1, wherein said at least one surface-active agent is a polyoxyethylene surface active agent.

5. A method according to claim 1, wherein said at least one corrosion inhibitor is selected from the group consisting of a carboxylic acid, an alkyl-sulfonate of barium, an alkyl-sulfonate of sodium and an amine salt of a fatty acid.

6. A method according to claim 1, wherein said coating is performed by spraying.

7. A method according to claim 1, wherein the cleaned metal product is dried in step a) for a period of time of between 2 and 20 seconds.

8. A method according to claim 1, wherein the coated metal product is dried in step c) for a period of time of between 2 and 20 seconds.

9. A method according to claim 1, wherein said metal product is a metal sheet, said dry film being formed on at least one side of said sheet.

10. A metal sheet coated with a dry film providing protection against corrosion obtained by the method of claim 1.

11. A method as claimed in claim 1, wherein the metal product is a metal sheet, said method further comprising the step of:

d) applying on the resulting dried coated metal sheet a second coating without first cleaning the metal sheet coated with the dry film.

12. A method as claimed in claim 1, wherein the metal product is a metal sheet, said method further comprising the step of:

d) applying on the resulting dried coated metal sheet paint without first cleaning the metal sheet coated with the dry film.

13. A method as claimed in claim 11, wherein the metal product is a metal sheet, said method further comprising the step of:

d) applying on the resulting dried coated metal sheet an enamelling without first cleaning the metal sheet coated with the dry film.

14. A method as claimed in claim 1, wherein the metal product is a metal sheet, said method further comprising the step of:

d) applying on the resulting coated dried metal sheet a coating obtained by galvanizing by dipping without first cleaning the metal sheet coated with the dry film.

15. A method for providing temporary protection against corrosion of a cleaned metal product consisting of the steps of:

a) drying said cleaned metal product;

b) coating at least one part of the metal product with an emulsion obtained by dispersion in water of 3 to 13% by volume of an oily phase, said oily phase comprising 75 to 90% by volume of at least one mineral oil, 5 to 10% by volume of at least one surface-active agent and 5 to 15% by volume of at least one corrosion inhibitor; and c) drying the resulting coated metal product by heating it to a temperature between 70° to 100° C. until a dry film is obtained, said dry film being present in an amount of from 300 to 800 mg/m$^2$ of coated product.

16. A method as claimed in claim 15, wherein the metal product is a metal sheet, said method further consisting of the step of:

d) applying on the resulting dried coated metal sheet a second coating without first cleaning the metal sheet coated with the dry film.

17. A method as claimed in claim 15, wherein the metal product is a metal sheet, said method further consisting of the step of:

d) applying on the resulting dried coated metal sheet paint without first cleaning the metal sheet coated with the dry film.

18. A method as claimed in claim 15, wherein the metal product is a metal sheet, said method further consisting of the step of:

d) applying on the resulting dried coated metal sheet an enamelling without first cleaning the metal sheet coated with the dry film.

19. A method as claimed in claim 15, wherein the metal product is a metal sheet, said method further consisting of the step of:

d) applying on the resulting coated dried metal sheet a coating obtained by galvanizing by dipping without first cleaning the metal sheet coated with the dry film.

* * * * *

UNITED STATES PATENT AND TRADEMARK OFFICE

CERTIFICATE OF CORRECTION

PATENT NO. : 5,391,396

DATED : February 21, 1995

INVENTOR(S) : Claude MORAND, et al.

It is certified that error appears in the above-indentified patent and that said Letters Patent is hereby corrected as shown below:

On the title page, Item [75], the second inventor was omitted from the inventorship. It should read:

--Claude Morand, Miramas; Philippe Antoine, Avignon, both of France--

Signed and Sealed this

Twenty-third Day of May, 1995

*Attest:*

Bruce Lehman

BRUCE LEHMAN

*Attesting Officer*

*Commissioner of Patents and Trademarks*